US006338612B1

(12) United States Patent
Spillner et al.

(10) Patent No.: US 6,338,612 B1
(45) Date of Patent: Jan. 15, 2002

(54) METHOD FOR LIMITING THE PRESSURE PROVIDED BY A HYDRAULIC PUMP

(75) Inventors: Robert Spillner, Dusseldorf; Hans-Willi Gerigk, Oberhausen, both of (DE)

(73) Assignee: TRW Fahrwerksysteme GmbH & Co. KG, Dusseldorf (DE)

( * ) Notice: Subject to any disclaimer, the term of this patent is extended or adjusted under 35 U.S.C. 154(b) by 0 days.

(21) Appl. No.: 09/445,349

(22) PCT Filed: Apr. 15, 1999

(86) PCT No.: PCT/EP99/02530

§ 371 Date: Mar. 9, 2000

§ 102(e) Date: Mar. 9, 2000

(87) PCT Pub. No.: WO99/56019

PCT Pub. Date: Nov. 4, 1999

(30) Foreign Application Priority Data

Apr. 23, 1998 (DE) ..... 198 18 141

(51) Int. Cl.[7] ..... F04B 19/24; F04B 49/00; F04B 23/02; F01C 19/08

(52) U.S. Cl. ..... 417/53; 417/283; 418/131

(58) Field of Search ..... 417/53, 310, 283; 418/131, 134, 135

(56) References Cited

U.S. PATENT DOCUMENTS

| | | | | | |
|---|---|---|---|---|---|
| 4,336,004 | A | * | 6/1982 | Grabb | 417/283 |
| 4,401,416 | A | * | 8/1983 | Tuckey | 417/283 |
| 4,834,631 | A | * | 5/1989 | Schrank et al. | 417/283 |

FOREIGN PATENT DOCUMENTS

| | | | |
|---|---|---|---|
| DE | 3105547 | | 1/1982 |
| GB | 637046 | * | 5/1950 |
| GB | 2116258 | | 9/1983 |

* cited by examiner

*Primary Examiner*—Timothy S. Thorpe
*Assistant Examiner*—Michael K. Gray
(74) *Attorney, Agent, or Firm*—Tarolli, Sundheim, Covell, Tummino & Szabo L.L.P.

(57) ABSTRACT

A hydraulic pump system having a pump for pressurizing fluid and a hydraulic chamber for receiving fluid from the pump. An even flow of fluid is outputted from the chamber to a valve assembly. The chamber is formed from a resonator and a resonator cover that are attached in a fluid tight manner by elastic fasteners. The resonator cover acts as a pressure controller in that when the pressure of fluid is of sufficient magnitude, this force creates a gap for controlling fluid pressure output to the valve assembly.

6 Claims, 3 Drawing Sheets

METHOD FOR LIMITING THE PRESSURE PROVIDED BY A HYDRAULIC PUMP

The present invention relates to a process to control the hydraulic pressure provided by a hydraulic pump and a hydraulic pump with pressure control.

Processes and devices for controlling the hydraulic pressure provided by a hydraulic pump are known in the art. Typically, modern hydraulic pumps, particularly for power assisted steering applications, are assembled from modular subassemblies or pump components that are arranged relative to each other. The pumps are designed to produce a hydraulic pressure matching the system requirements and, in the line coming from the pump, or in a pump area subject to operating pressure, a pressure control valve is arranged. The design of this pressure control valve can vary. Typical are springloaded pressure control valves, which open in case of overpressure and may also carry oil in a bypass leading back to the reservoir.

Despite increasing miniaturization and a production and materials engineering related decrease in the costs of the corresponding components, particularly pressure control valves, said components continue to be a major cost factor in the production of hydraulic systems using hydraulic pumps. They are separate units that must be separately produced and separately installed. This substantially increases production costs, installation costs and overall system production costs.

On the other hand, such pressure control valves cannot currently be dispensed with since an undesirable overpressure in the hydraulic system may damage other components, which for cost reasons are all designed for minimum pressure ratios, or may produce substantial malfunctions.

Based on the described state of the art, the object of the present invention is to define a process and a hydraulic pump permitting pressure control on the one hand and elimination of separate and/or additional pressure control valves on the other hand.

To attain this object on the process side, the invention proposes a process to control the hydraulic pressure provided by a hydraulic pump that has at least two pump components that are connected in pressure tight manner by fastening means in order to form a hydraulically pressurized volume, characterized in that at least one of the pump components is arranged on another such that the former can be moved relative to the other pump component above a given hydraulic pressure within the pump interior to open the pressurized volume at least slightly.

The process according to the invention has the significant advantage of component reduction, which is expressed, in particular, by the elimination of conventional pressure control valves. The manufacturing method, however, hardly differs from the previous manufacturing method so that pure production cost savings result.

An exemplary design for a power assisted steering application of a hydraulic pump, which forms part of prior art, comprises a valve assembly, a pump body, a resonator chamber and a resonator cover. Together, these components are disposed within a housing providing an oil reservoir from which practically only the valve assembly protrudes for connecting the hydraulic intake and return lines.

According to the invention, the valve assembly, pump body, resonator and resonator cover are now fastened by means of screws for which force F is applied. The resonator cover is typically pressurized with the operating pressure. Starting from a certain pressure, the hydraulic force acting on the resonator cover becomes greater than the prestressing force of the bolts, which is adjusted to this pressure, so that gaps may form between valve assembly, pump body, resonator and resonator cover. A small volumetric oil flow passes through these gaps into the surrounding reservoir area, which creates the desired pressure control.

This object is attained in that the screws or bolts, the mechanical properties of which are all known and predefined, are tightened with a given torque. The elastic properties of the screw material together with the given torque makes it possible positively to predetermine the liftoff pressure or the pressure at which gaps are formed.

Until now, torques were selected to be high enough so that no gaps could form in the pressure areas where the pressure control valve had not already previously responded. For this reason static seals are inserted between the individual pump components. This practically prevents a volumetric oil flow. The pressure is controlled by means of conventional pressure control valves.

In contrast, the process according to the invention represents a significant improvement since, through the type of mounting provided, the conventionally assembled pump now becomes a self-contained pressure control system in which the holding forces are placed in direct relation to the internal pressure produced.

Independent of the pure fastening force, the type of the fastening elements can also exercise the same process function. It is quite feasible, for example, to assemble the individual pump components by means of clamp-type mechanical fastening elements, which for their part have sufficient elastic properties to exercise a pressure control function in accordance with the process in that they permit the formation of gaps starting from a specific hydraulic pressure within the interior of the pump components. Besides, gaps may form between two or also between several pump components.

The invention provides a completely novel hydraulic pump, which itself has means to control the hydraulic pressure provided, namely fastening means that permit relative motion of pump components above a given hydraulic pressure within the pump interior to open the pressurized volume at least slightly.

Advantageously, these means are the fastening bolts for the resonator cover, which are tightened with a given torque, whereby the mechanical properties of the bolts are given and defined.

BRIEF DESCRIPTION OF THE DRAWINGS

Additional advantages and features of the invention will become evident from the discussion below by means of the figures. The following show.

DETAILED DESCRIPTION OF THE INVENTION

Figure 1:
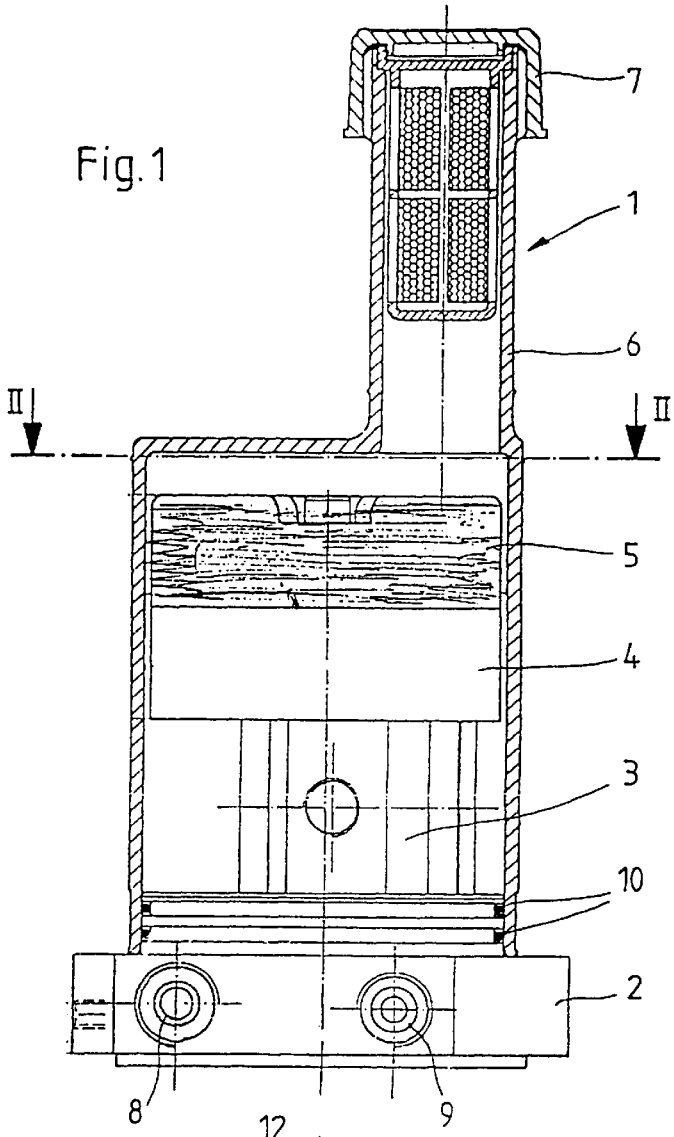
FIG. 1 a schematic partial section of an exemplary embodiment of a hydraulic pump.

The figures show an exemplary embodiment of a hydraulic pump. The entire hydraulic pump unit 1 comprises a valve assembly 2, a pump housing 3, a resonator 4 and a resonator cover 5. Said components are enclosed by a reservoir housing 6 that is mounted to a corresponding cylindrical shoulder of the valve assembly using seals 10. Reservoir housing 6 is filled with hydraulic fluid via cover 7 and simultaneously represents the hydraulic reservoir.

The valves 8, 9 serve for sucking in and pressing out the hydraulic fluid. The pump chamber 20 contains mechanical components wherein the hydraulic fluid is put under pressure. After leaving the pump chamber 20, the hydraulic fluid passes through the resonator 4, in order obtain an even flow.

Figure 2:
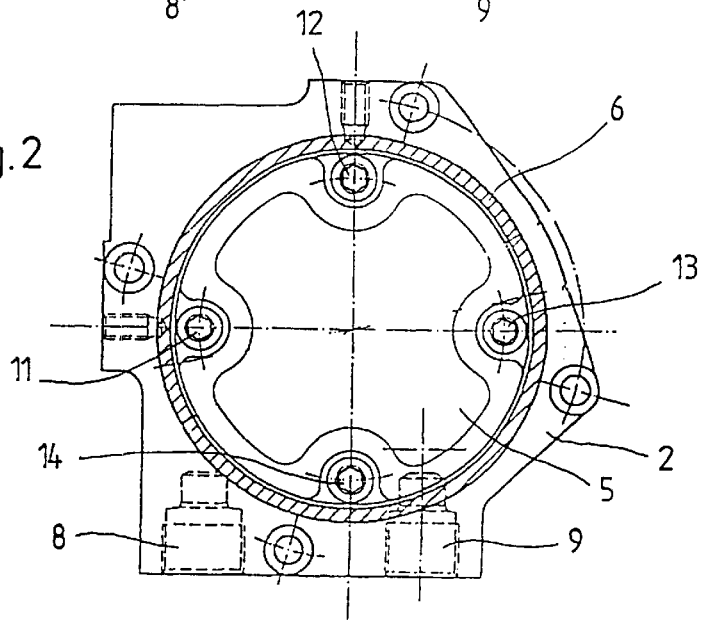
FIG. 2 a section along line II—II according to FIG. 1.

FIG. 2 shows bolts 11, 12, 13 and 14 used to fasten resonator cover 5 to the resonator (not depicted), which is located underneath.

FIGS. 3 to 8 show individual details of said components.

Figure 4:
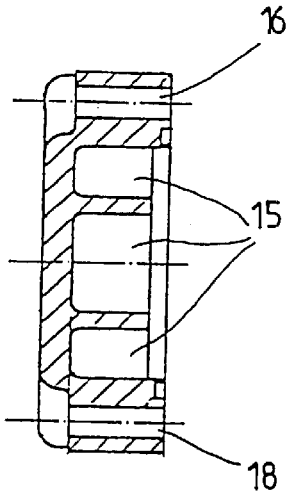
FIG. 4 a sectional view along line IV—IV in FIG. 3.
Figure 3:
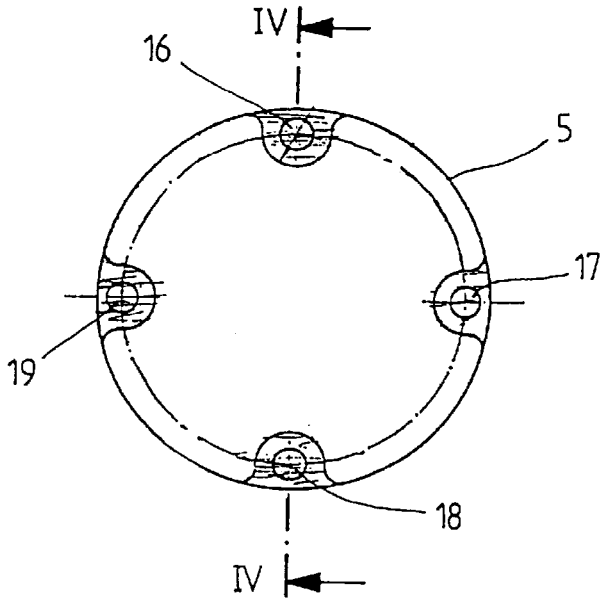
FIG. 3 a top view onto the resonator cover.

The resonator cover, according to FIGS. 3 and 4, is provided with bores 16, 17, 18 and 19 into which said bolts 11, 12, 13, 14 are inserted. The resonator cover has a resonator chamber 15, which is known per se.

Figure 6:
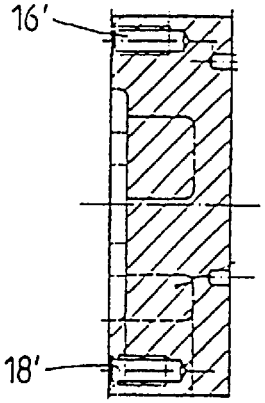
FIG. 6 a sectional view along line VI—VI in FIG. 5.
Figure 5:
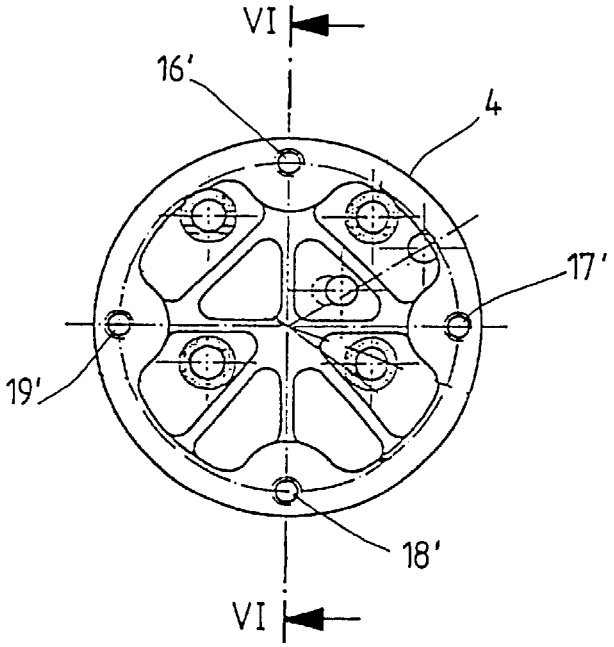
FIG. 5 a top view onto a resonator chamber.
Figure 7:
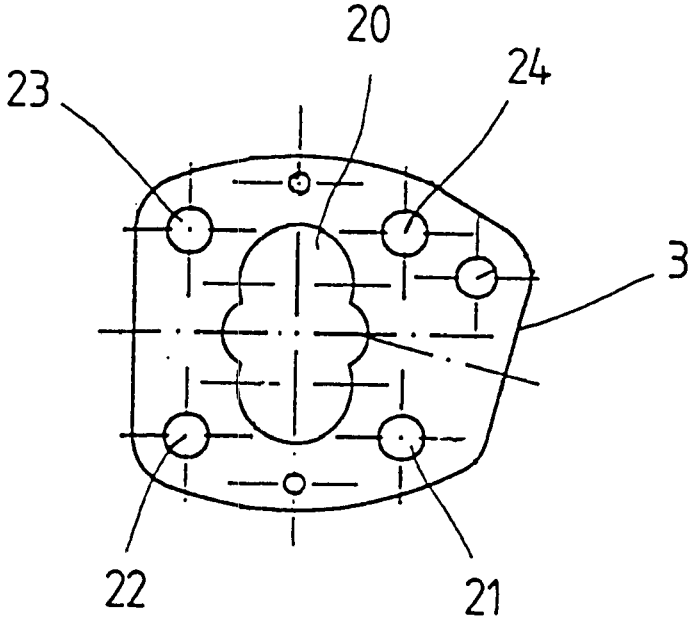
FIG. 7 a top view onto a pump chamber.

The resonator itself guides the oil from the pump to the chambers in the cover and finally to the valve assembly. Resonator 4, according to FIGS. 5 and 6, is provided with blind holes into which bolts 11, 12, 13, 14 are inserted. After assembly, blind holes 16', 17', 18', 19' are aligned with bores 16, 17, 18 and 19 of the resonator cover.

Figure 8:
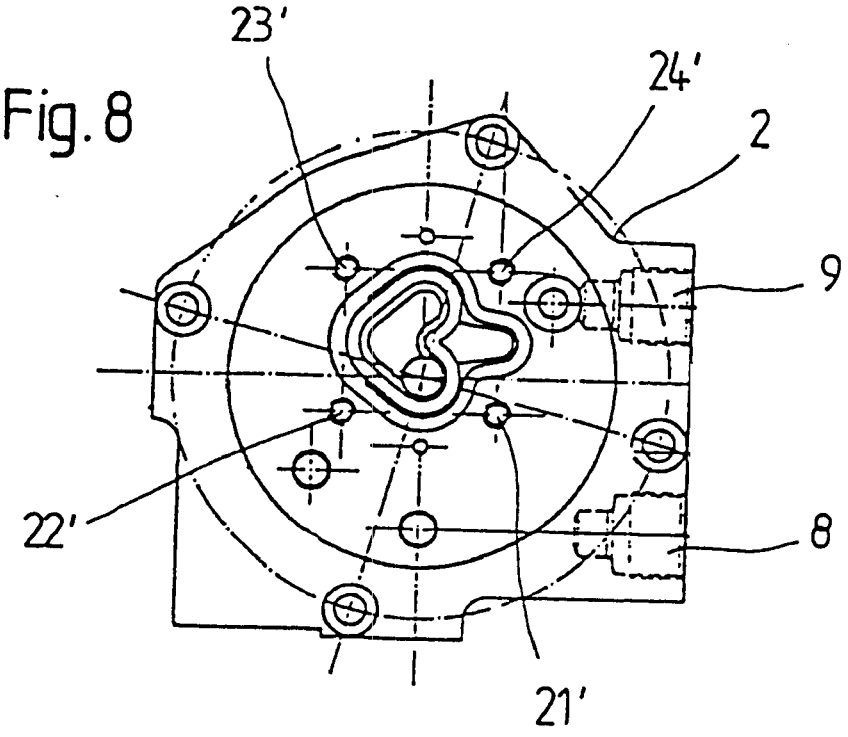
FIG. 8 a view of a valve assembly.

For fastening with the pump, bores are provided on the underside of the resonator, which align with bores 21, 22, 23, 24 of pump housing 3 when the units are assembled. In addition, the bores also align with bores 21', 22', 23' and 24' in valve assembly 2 as shown in FIG. 8 on a slightly reduced scale.

Thus pump housing 3 can be mounted on valve assembly 2 and thereupon resonator 4 and interconnected with bolts and screws (not depicted). In addition, the resonator cover can be fastened to the resonator by means of screws or bolts 11, 12, 13, 14.

To implement the invention, it is advantageous to use said screws 11, 12, 13, 14, which are fixedly defined with respect to their material properties, to fasten the resonator cover to the resonator using a given calculated torque. The calculation is based on the elastic and other material properties of the screws and takes into account the pressure ratios occurring in the lid. Since here the hydraulic medium is redirected from a straight flow, a corresponding internal pressure builds up, which subjects said screws 11, 12, 13, 14 to tensile stress. Due to the given torque and the elastic properties of the material, the resonator cover is lifted from the resonator starting from a certain pressure to form a gap, so that automatic pressure control is provided. When the pressure falls below that point, the resonator cover makes contact again and forms an adequate seal.

The same teaching can also be applied to the connecting screws of the lower components.

The exemplary embodiments described serve for illustration and shall not be construed as a limitation. In particular, other types of fastening elements or quite differently designed opening areas may be provided. For example, radial indentations may be formed as a function of the pressure, elastic clamps may be used, or even drive units for the relative displacement of housing parts, for example in the sense of a rocker or the like.

What is claimed is:

1. A process for controlling hydraulic pressure provided by a hydraulic pump, the process comprising the steps of:

positioning a resonator cover relative to a resonator to form a hydraulic chamber for receiving fluid from the pump and for outputting an even flow of fluid toward a valve assembly;

attaching the resonator cover to the resonator in a fluid-tight manner using a plurality of fasteners having known elastic properties, the fasteners providing a first force that holds the resonator cover relative to the resonator;

operating the hydraulic pump to provide fluid to the hydraulic chamber, fluid pressure within the chamber subjecting the fasteners to a second force that acts opposite the first force; and moving the resonator cover relative to the resonator when the second force is greater than the first force to open a gap for controlling pressure of the fluid output to the valve assembly, movement of the resonator cover relative to the resonator being a function of the elastic property of the fasteners and the first and second forces.

2. The process of claim 1 wherein the step of attaching the resonator cover to the resonator includes providing bolts which comprise the fasteners.

3. The process of claim 1 wherein the step of attaching the resonator cover to the resonator in a fluid-tight manner further includes the step of:

tightening the plurality of fasteners to a given torque.

4. An apparatus comprising:

a pump for pressurizing fluid; and a hydraulic chamber for receiving fluid from the pump and for outputting an even flow of fluid to a valve assembly, the hydraulic chamber being formed from a resonator and a resonator cover that are attached in a fluid tight manner by a plurality of fasteners having known elastic properties, the fasteners providing a first force that holds the resonator cover relative to the resonator;

the pump, when operated, providing fluid to the hydraulic chamber, fluid pressure within the hydraulic chamber subjecting the fasteners to a second force that acts opposite the first force;

the resonator cover moving relative to the resonator when the second force is greater than the first force to open a gap for controlling pressure of fluid output to the valve assembly, movement of the resonator cover relative to the resonator being a function of the elastic property of the fasteners and the first and second forces.

5. The apparatus as defined in claim 4 wherein the fasteners are bolts.

6. The apparatus as defined in claim 5 wherein the bolts are tightened to a given torque when attaching the resonator cover to the resonator.

* * * * *